US011130165B2

(12) United States Patent
Grant

(10) Patent No.: US 11,130,165 B2
(45) Date of Patent: Sep. 28, 2021

(54) ELECTRONIC SERVO POWERED PILOT RELEASE MECHANISM

(71) Applicant: Coe Press Equipment Corp., Sterling Heights, MI (US)

(72) Inventor: Bruce R. Grant, Clarkston, MI (US)

( * ) Notice: Subject to any disclaimer, the term of this patent is extended or adjusted under 35 U.S.C. 154(b) by 192 days.

(21) Appl. No.: 16/138,361

(22) Filed: Sep. 21, 2018

(65) Prior Publication Data

US 2020/0094307 A1 Mar. 26, 2020

(51) Int. Cl.
*B21D 43/09* (2006.01)

(52) U.S. Cl.
CPC ..... *B21D 43/09* (2013.01)

(58) Field of Classification Search
CPC ..... B21D 43/00; B21D 43/003; B21D 43/02; B21D 43/04; B21D 43/08; B21D 43/09; B21D 43/26; B30B 15/30; B65H 20/02; B65H 226/176; B65H 226/177; B65H 226/186; B65H 226/187; G01L 1/22; G01L 1/225
See application file for complete search history.

(56) References Cited

U.S. PATENT DOCUMENTS 2,805,449 A * 9/1957 Martin, Jr. ..... D01H 13/22 19/240
5,150,022 A * 9/1992 Waddington ..... B21D 43/09 271/8.1
5,833,105 A * 11/1998 Stuber ..... B21D 43/022 226/4
2016/0251189 A1* 9/2016 Reiman ..... B65H 20/02 226/91

* cited by examiner

*Primary Examiner* — Shelley M Self
*Assistant Examiner* — Fred C Hammers
(74) *Attorney, Agent, or Firm* — The Law Offices of John G. Posa

(57) ABSTRACT

In a roller-style feed mechanism, a feed roll is opened and closed for the purpose of pilot release using a direct-coupled servo motor as opposed to pneumatic or hydraulic cylinders. The electronically controlled servo motor drives a rotating shaft with eccentric cams that interact with cam followers causing the feed rollers separate for pilot release. The cam followers produce a force sufficient to overcome nip pressure when separating the feed rollers during pilot release. The electronically controlled servo motor is preferably operative to sense the point where the cams contact the cam followers after the upper feed roller is closed on the feed material, and automatically sense resistance to determine where the upper roll begins to lift so as to compensate for different material thicknesses.

4 Claims, 2 Drawing Sheets

ELECTRONIC SERVO POWERED PILOT RELEASE MECHANISM

FIELD OF THE INVENTION

This invention relates generally to press feed mechanisms and, in particular, to improvements in roller style press feed mechanisms.

BACKGROUND OF THE INVENTION

Press feed mechanisms are used to feed coiled or rolled flat material, usually metal of some sort, into stamping press tooling or cut-off shears to produce blanks or parts for various manufactured products. Over the years a variety of press feed mechanisms have been invented and used for this purpose. Today the most common press feed type is a roller style feed which uses a pair of precision rollers powered by a servo motor to nip the material strip and feed it into a shear or stamping die. FIG. 1 is a section view of a typical feed mechanism. Rollers 111, 112 are most commonly powered and controlled using a servo motor 101, an electronic servo drive and a closed loop motion control.

Stamping dies can be used for blanking or they can be of the progressive type. Blanking dies produce a finished product in a single station with a single stroke of the press. Progressive dies, on the other hand, use multiple stations to progressively add features to the material strip in each die station to produce the finished product. During the portion of every press cycle, where the die is open, the feed indexes to move the strip from one station in the die to the next to produce a finished product, then separate it from the strip at the final station.

Progressive dies can have any number of stations from 2 to 20 or more, as necessary, to create the finished product. Progressive dies require a feed mechanism that is capable of an operation known as pilot release. Pilot release is used to reposition the strip on each cycle of the press so that it is precisely aligned to the die on each die engagement. Pilot release prevents feed length error and material tracking from accumulating over the multiple feed cycles required to reach the end of the die and finish making the product. Accumulated position error and material tracking would cause forming or punching errors to occur in the later stations of the die and yield an incorrect result.

Pilot release is the act of releasing the material strip from the feed mechanism at a specific point in the press cycle to allow alignment features within the die to precisely align the strip with the tooling before the die closes completely so it can produce the correct stamping result. It is critical for the feed mechanism to re-establish its hold on the material before it is released by the die when it opens. The timing of pilot release is critical to ensure accurate results.

It is important for the pilot release to occur precisely at the point in the cycle where the die is taking control of the strip, such that either the feed or the die has control of the strip at all times throughout the press cycle. There can never be a time when both the die and the feed are exerting control simultaneously as this may cause damage to the strip, the die or the feed mechanism and could produce an unacceptable stamping result. Additionally, there can never be a time when neither die nor feed has control of the strip because this would allow the strip to fall back into the loop area and result in excessive strip position error.

In the case of the roller type feed mechanism, shown in FIG. 1, the most commonly used method of feed roll clamping control employs pneumatic or hydraulic cylinders.

In those cases, one or more cylinders 103, are trunnion mounted 105, and attached to the feed roll support structure 107 by a rod clevis with clevis pin 110, so that the upper feed roll 111, is opened or closed by retracting or extending the cylinder or cylinders 103. The air or hydraulic pressure can be adjusted to control the feed roll pressure to accommodate different materials and feed performance requirements to prevent damage to the material and to also prevent slippage while feeding.

FIG. 1 shows a section view of a typical roll feed that uses pneumatic cylinders to open and close the upper feed roll. FIG. 1 shows the lower, fixed feed roll 112, the movable upper feed roll 111, and the pneumatic cylinder 103 that controls the lifting and lowering of the upper feed roll as well as controlling the roll nip pressure. The upper feed roll 111 is supported at both ends by upper roll support plates 107 which contain the radial load bearings that support the upper feed roll journals and allow the roll to rotate freely. The upper roll support plates are attached to the outer support frame of the feeder frame using pivot shafts 115 and plain bearings 117 that allow the plates to rotate freely to open and close the upper feed roll. The cylinders are connected to the upper roll support plates by a cylinder rod clevis 109 and clevis pins 110, that allow the angle between the cylinder and the support plates to vary as the roll is opened and closed. The cylinder, in turn is supported and connected to the feeder frame using trunnions, 105, and trunnion mounts 119 to allow the cylinder to rotate and self-align as the upper roll support frame, 107, moves.

The supply of pneumatic or hydraulic pressure and flow to the cylinders is controlled using a directional control valve 113, pressure regulator and plumbing. The directional valve is typically controlled by electrical windings, called solenoids 115, which, when energized, cause a spool in the valve to shift and supply flow and pressure to one cylinder port or the other to cause the feed rolls to either close or open to clamp or release the material strip. A signal issued by the press and monitored by the feed control system is used to control the state of the directional valve 113, and thus the open/close state of the feed rolls, items 111 and 112.

The sequence of events just described results in a response time delay that is equal to the total combined time required to process the signal from the press, energize the valve solenoid, shift the valve spool and, finally, the time required for the air or fluid to flow into one side of the cylinder(s) and out of the other to cause the roll to open or close. The combined delay can be anywhere from as little as 0.04 seconds to as much as 0.2 seconds.

The resulting pilot release response lag, in terms of press position, is dependent upon press speed and the length of the response delay. For example, if the press is running at 60 strokes per minute (SPM), then a 0.1 second response delay will result in a press position error of 36 degrees when the action finally occurs. On the other hand, if the press is operating at 100 SPM then the 0.1 second delay results in the release or clamp occurring 60 degrees after it needed to happen. The potential negative effects include difficulty in establishing correct release timing, damage to the strip, bad part quality, damage to press tooling and short feeding.

These response delays can be overcome using a feature called "automatic advance" that is available on some press controls. The automatic advance feature causes the signal for pilot release that is issued by the press control, to be automatically advanced based on the current speed of the press so that the actual timing of the pilot release action occurs at the correct position in the press cycle. In the above example, if the press is running 60 SPM then the signal for the release would be advanced by 36 degrees so the actual release of the strip would occur at the correct point in the press cycle. If the press is operating at 100 SPM then the signal would be issued 60 degrees in advance of the desired release point. The control dynamically calculates the signal advance based on the current press cycle rate and the known pilot release delay.

The method just described is effective only if the press control has the automatic advance feature and if the exact release delay is known and remains fixed. Unfortunately, the delay time does not always remain constant. The time delay can change based on variation in operating pressure, which must change to accommodate different material strip properties and performance requirements. The time delay also changes over time due to wear of the system components and contamination of the air or fluid that results in a change in the valve shift time, cylinder movement and flow characteristics. Even if the response delays can be overcome, they are often quite limited in terms of the press speed at which they can operate effectively.

SUMMARY OF THE INVENTION

This invention relates to improvements in roller-style feed mechanisms wherein, in particular, a feed roll is opened and closed for the purpose of pilot release using a direct-coupled servo motor as opposed to pneumatic or hydraulic cylinders. In a typical application, the feed mechanism is used to deliver coiled or rolled flat material into a press or other piece of equipment for further processing. A feed motor causes upper and lower rollers to rotate about parallel, spaced-apart axes to advance the feed material through the feed mechanism. However, in contrast to existing systems, an electronically controlled servo motor drives a rotating shaft with eccentric cams that interact with cam followers causing the feed rollers separate for pilot release.

In the preferred embodiment a device such as a pneumatic cylinder causes the feed rollers to apply a consistent, predetermined pressure against the feed material, and the cam followers produce a force sufficient to overcome the pressure applied by the device when separating the feed rollers during pilot release.

Also in the preferred embodiment, the upper roller is mounted in a support frame; and the cam followers move the mounting frame upwardly to separate the upper roller from the lower roller for pilot release.

The electronically controlled servo motor is preferably operative to sense the point where the cams contact the cam followers after the upper feed roller is closed on the feed material. In particular, the system is operative to sense resistance to determine where the upper roll begins to lift so as to automatically compensate for different material thicknesses.

DETAILED DESCRIPTION OF THE PREFERRED EMBODIMENTS

Figure 2:
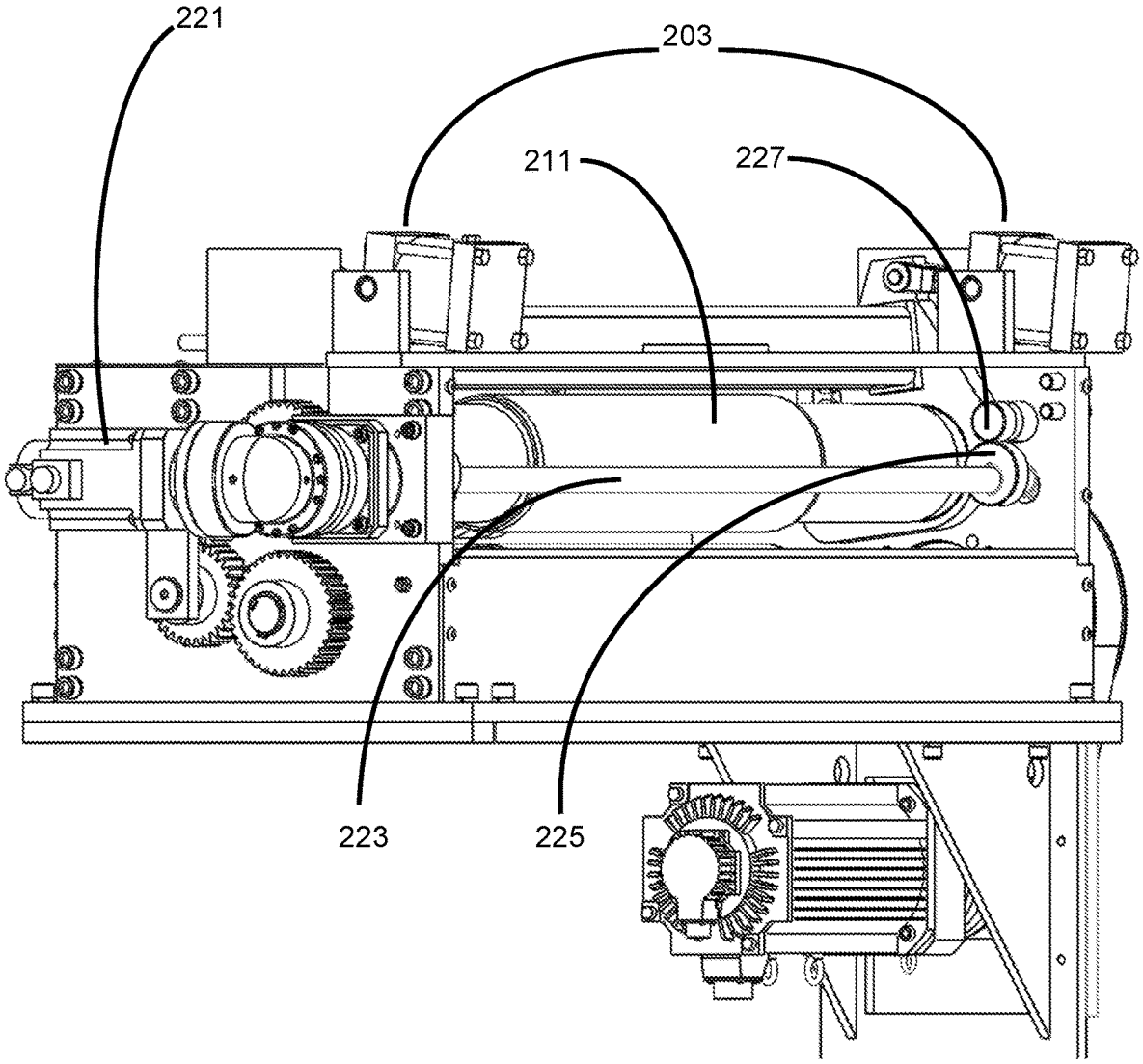
FIG. 2 is an oblique view of a preferred embodiment of the invention.

The invention relates to a system and method, as shown in FIG. 2, wherein a feed roll 211 is opened and closed for the purpose of pilot release using a direct-coupled servo motor 221. Servo motor 221 drives a shaft 223 with eccentric lobes 225. The lobes 225 work against cam followers 227 mounted on upper roll support frame 207, causing the feed roll 211 to lift off of the material strip for pilot release. While only one lobe 225 and follower 227 are clearly visible in FIG. 2, it will be appreciated that a corresponding lobe/follower set is provided on the left side of the support frame, simultaneously driven by the same shaft 223.

This invention provides many advantages. Modern servo technology eliminates the delays resulting from the use of solenoid operated directional control valves and the movement of compressed air or fluid. The approach also eliminates the inefficiency and losses associated with existing systems, as well as the cost of expelling large quantities of compressed air into the atmosphere or the heat losses that result from the use of inefficient fluid power as well as the high maintenance costs that go along with those systems. The invention also eliminates the need for any mechanical adjustment by the operator to optimize the precision and effectiveness of the release. This allows the use of the cylinders to provide a wide opening of the roll for the purpose of inserting new material into the feed even if the leading edge of the new strip is significantly deformed as a result of mishandling.

Figure 1:
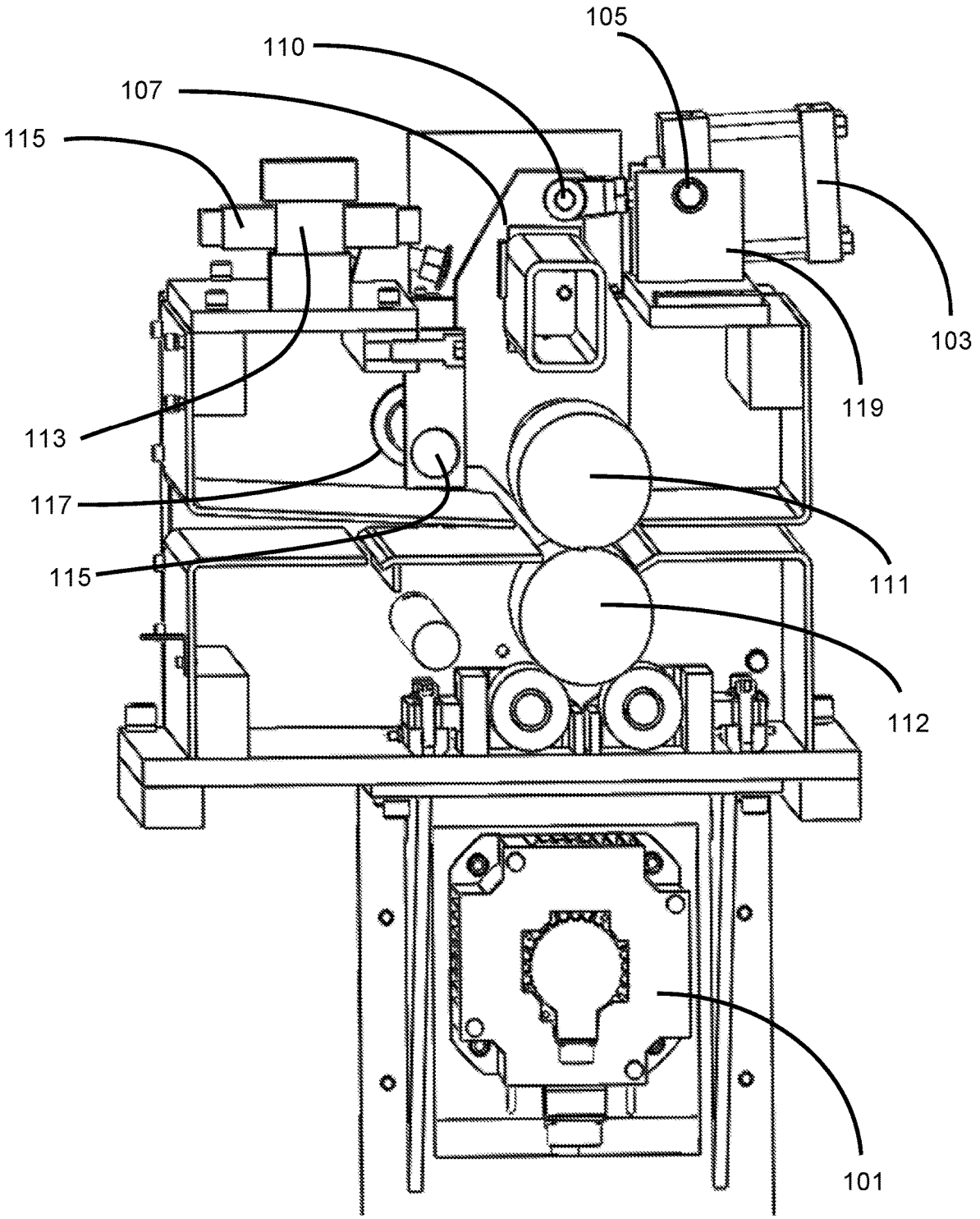
FIG. 1 is a section view of a typical feed mechanism.

In accordance with the invention, a cam mechanism is used to lift and lower a movable roll a precise amount to release the material strip, thereby allowing pilot pins to align it. In contrast to the prior-art system of FIG. 1, the invention eliminates the repeated, alternating application and removal of pneumatic pressure to cause the cylinder to extend and retract to open and close the feed roll. Instead, a controlled pneumatic pressure is applied constantly to the cylinder to keep the roll closed and to control the feed roll nip pressure. The opening and closing of the feed roll for pilot release is caused by the rotation of the cam mounted on the cam shaft and coupled to and controlled by a servo motor.

The cam applies force against a cam follower that is mounted in the upper roll support frame in a way that causes it to overcome the cylinder force and to open the feed roll. When the cam is rotated by the servo motor in the opposite direction the cylinder forces the closure the feed roll. The rotation of the shaft and cams is minimized and optimized by using the drive control technology to sense resistance and determine the correct position where the roll begins to lift. Using this technology allows the elimination of any mechanical adjustment to compensate for different material thickness.

The invention also does not require manual mechanical adjustment of the cams or cam followers to compensate for different strip thickness, as in the prior. Instead, the invention uses the servo drive and control technology to sense the point where the cam contacts the cam follower after the upper feed roller is closed on the material strip. This ensures that there is no wasted motion required to reach the point of roller lift. The amount of lift is precise and consistent, regardless of strip thickness. The prior art requires that a manual adjustment be made by the operator to initialize the mechanism each time there is a change in strip thickness. If the adjustment is not made correctly each time there is a change in strip thickness, the roll lift distance will vary or, if the change in material thickness is substantial, it might not even lift the roller at all. This invention overcomes those limitations as well.

The invention claimed is:

1. A feed mechanism adapted to deliver coiled or rolled flat material having a thickness into a press or other piece of equipment, comprising:

an upper feed roller and a lower feed roller;

a feed motor causing the upper and lower rollers to rotate about parallel, spaced-apart axes to advance a feed material through the feed mechanism;

an electronically controlled servo motor driving a rotating shaft that is parallel and spaced apart from the axes of the upper and lower feed rollers;

opposing cams mounted on the rotating shaft that interact with opposing cam followers coupled to one of the feed rollers, such that when the shaft is rotated in a first direction by the servo motor, the upper feed roller is lifted for pilot release, and when the shaft is rotated in an opposing direction by the servo motor, the upper feed roller is closed on the feed material;

wherein the electronically controlled servo motor is operative to sense resistance to determine where the upper roll begins to lift to automatically compensate for different material thicknesses; and wherein the electronically controlled servo motor is operative to sense the point where the cams contact the cam followers after the upper feed roller is closed on the feed material such that the amount of lift is precise and consistent regardless of material thickness.

2. The feed mechanism of claim 1, including at least one device causing the feed rollers to apply a consistent, predetermined pressure against the feed material; and wherein the cam followers produce a force sufficient to overcome the pressure applied by the device when separating the feed rollers during pilot release.

3. The feed mechanism of claim 2, wherein the device is a pneumatic cylinder.

4. The feed mechanism of claim 1, wherein the upper roller is mounted in a support frame; and the cam followers move the support frame upwardly to separate the upper roller from the lower roller for pilot release.

* * * * *